United States Patent [19]

Massonnet

[11] Patent Number: 4,682,816

[45] Date of Patent: Jul. 28, 1987

[54] EASY CHAIR

[76] Inventor: Henry Massonnet, FR-01760 Nurieux-Volognat, France

[21] Appl. No.: 882,262

[22] Filed: Jul. 7, 1986

[30] Foreign Application Priority Data

Jul. 9, 1985 [FR] France ..... 85 10691

[51] Int. Cl.[4] ..... A47C 1/02

[52] U.S. Cl. ..... 297/359; 297/28; 297/239; 297/440; 297/DIG. 2

[58] Field of Search ..... 297/359, 360, 377, DIG. 2, 297/22, 27, 28, 239

[56] References Cited

U.S. PATENT DOCUMENTS 991,202 5/1911 Doehrer ..... 297/28
2,282,270 5/1942 Vallone ..... 297/359
3,211,495 10/1965 Nielsen ..... 297/377
4,522,446 6/1985 Sheridan ..... 297/377

FOREIGN PATENT DOCUMENTS 2323313 4/1974 Fed. Rep. of Germany ..... 297/239
3045827 7/1982 Fed. Rep. of Germany ..... 297/359

*Primary Examiner*—Francis K. Zugel
*Attorney, Agent, or Firm*—Dowell & Dowell

[57] ABSTRACT

This invention relates to an easy chair comprising a seat surface fixed to the frame and with respect to which are pivotally mounted, to the rear, a backrest with several positions and, at the front, a leg rest composed of two hinged panels. The backrest is maintained in its various positions by means of the armrests.

9 Claims, 9 Drawing Figures

EASY CHAIR

BACKGROUND OF THE INVENTION

1. Field of the Invention

The present invention relates to easy chairs and more particularly to those used out of doors.

2. History of the Art

A considerable number of easy chairs, reclining chairs and the like intended for relaxing out of doors exist on the market. Certain of these devices are of the "wheelbarrow" type, i.e. they comprise a frame of which one of the ends is associated with a pair of wheels. In this type of article, the backrest is sometimes inclinable in several positions, while the leg rest is made in one piece with the article or is independent thereof. In certain other cases, easy chairs of the type in question exist, of which the leg rest is articulated with respect to the seat surface.

In all cases, it is necessary for the user to rise from the chair if he wishes to change the inclination of the backrest and/or of the leg rest, which is a drawback. In addition, the so-called "wheelbarrow"-type easy chairs cannot be stacked due to the presence of the wheels.

OBJECT OF THE INVENTION

It is an object of the improvements forming the subject matter of the present invention to overcome the drawbacks of the known easy chairs and to produce such a chair which responds better than heretofore to the various desiderata of the users.

The invention will be more readily understood on reading the following description with reference to the accompanying drawings, in which:

DESCRIPTION OF THE PREFERRED EMBODIMENT

Figure 1:
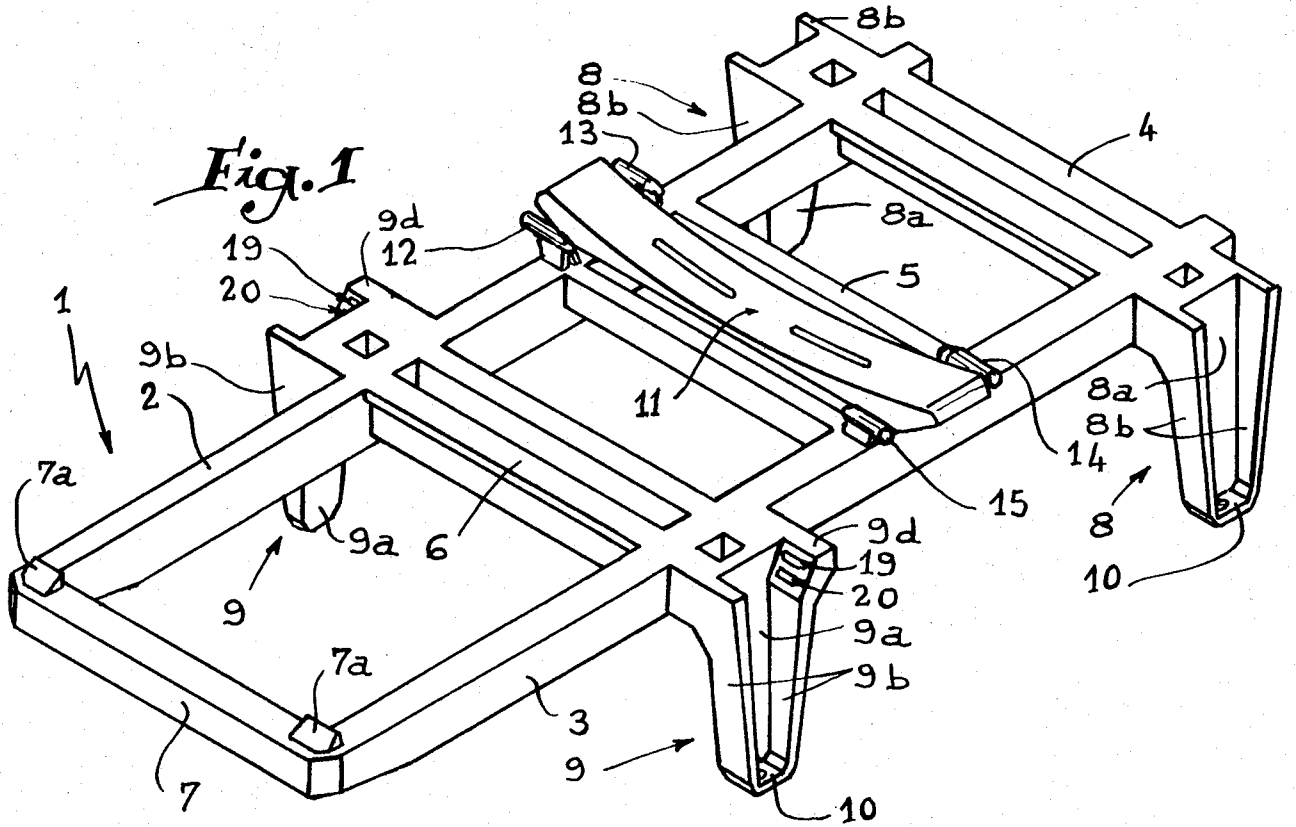
FIG. 1 is a view in perspective of the frame of an easy chair according to the invention.

Referring now to the drawings, the easy chair according to the invention essentially comprises a frame 1 illustrated in FIG. 1. This latter comprises two longitudinal elements 2, 3 joined by crosspieces 4, 5, 6 and 7. It is observed that crosspiece 4 joins one of the ends of the two longitudinal elements 2 and 3, whereas crosspiece 6 lies at about two thirds of the length thereof. As for crosspiece 7, it joins, as illustrated, the ends of the longitudinal elements opposite those which are joined by crosspiece 4.

It will be noted that, opposite crosspieces 4 and 6, the outer face of the longitudinal elements 2 and 3 have legs 8, 9 respectively, depending therefrom which have a horizontal transverse section in the form of a U of which the central vertical web 8*a*, 9*a* is placed near each longitudinal element, while flanges 8*b*, 9*b* are directed outwardly. The flanges of each leg are slightly convergent towards the ground and are joined by a foot 10 adapted to rest on the ground.

In other words, the legs are generally in the form of an upwardly open V.

Figure 2:
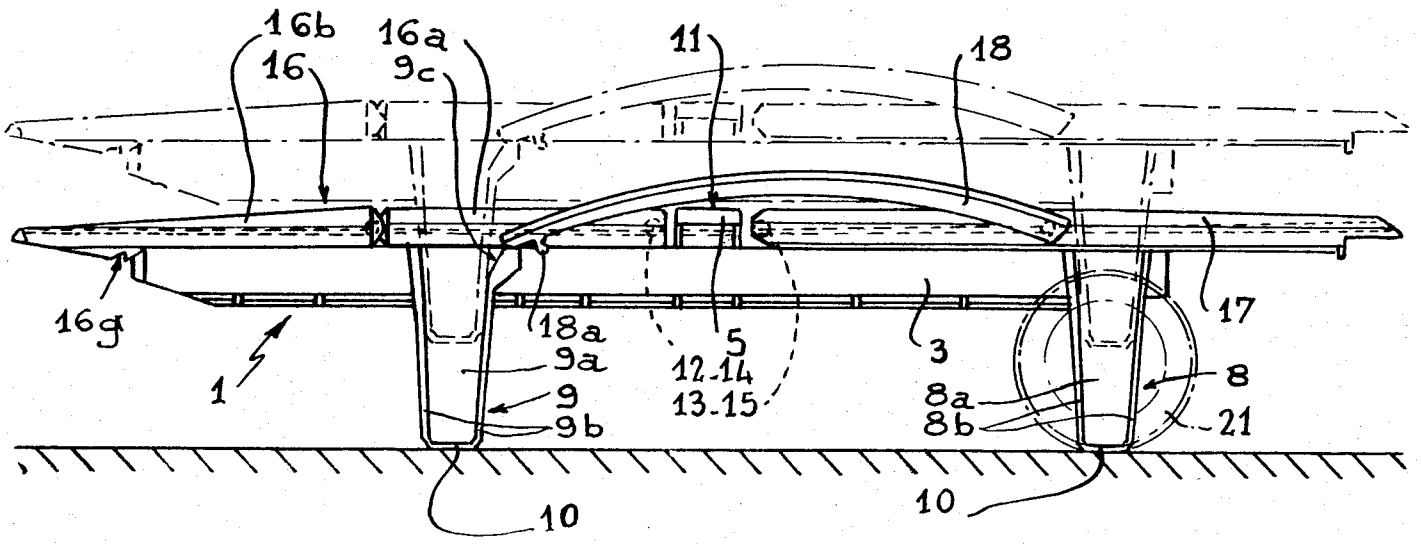
FIG. 2 is a side view of the easy chair in the position wherein all its elements are extended.

One of the flanges 9*b* of the legs 9 which lies to the rear comprises an inclined partition 9*c* for reasons which will be better explained hereinbelow. Above the crosspiece 5 which lies roughly in the middle of longitudinal elements 2 and 3, but whose position may vary, a seat surface 11 has been placed, constituted by a narrow transverse lath which is fixedly associated on top of the longitudinal elements 2 and 3. On either side of the two ends of the seat surface 11, there are provided two horizontal pivots 12, 13 and 14, 15. Pivots 12 and 14 are in alignment with each other so as to constitute with a corresponding part a hinge for a leg rest 16 (FIG. 2). Likewise, pivots 13 and 15 serve for the articulation of a backrest 17 with respect to the seat surface 11.

Figure 3:
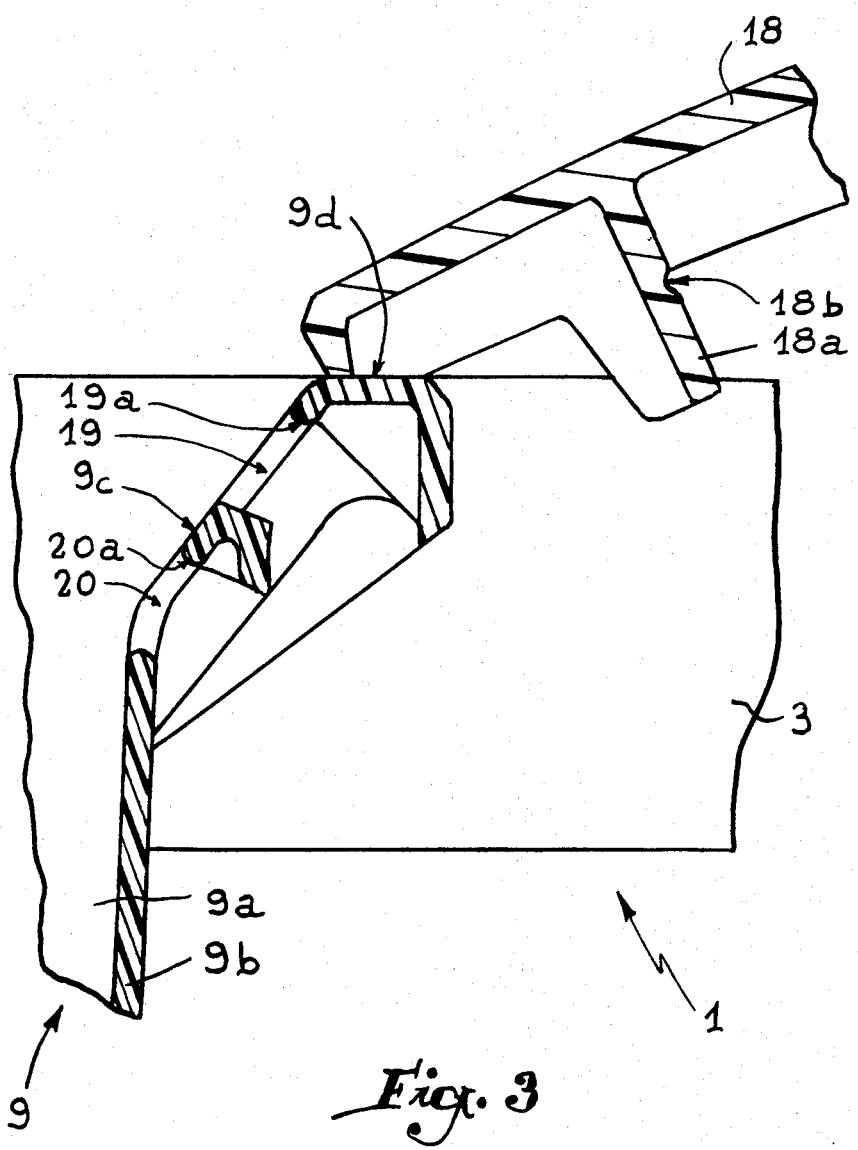
FIG. 3 is a view in detail, on a larger scale, showing in section the manner in which the end of each armrest is in abutment on a part of the frame in the retracted position of said armrests.

On each of the lateral sides of the backrest 17 there is hinged an armrest 18 whose free end rests against a horizontal extension 9*d* of the oblique partition 9*c* of the corresponding leg, as illustrated in FIG. 3. Of course, when the backrest is folded down against the frame, it is maintained in horizontal position by crosspiece 4.

Figure 4:
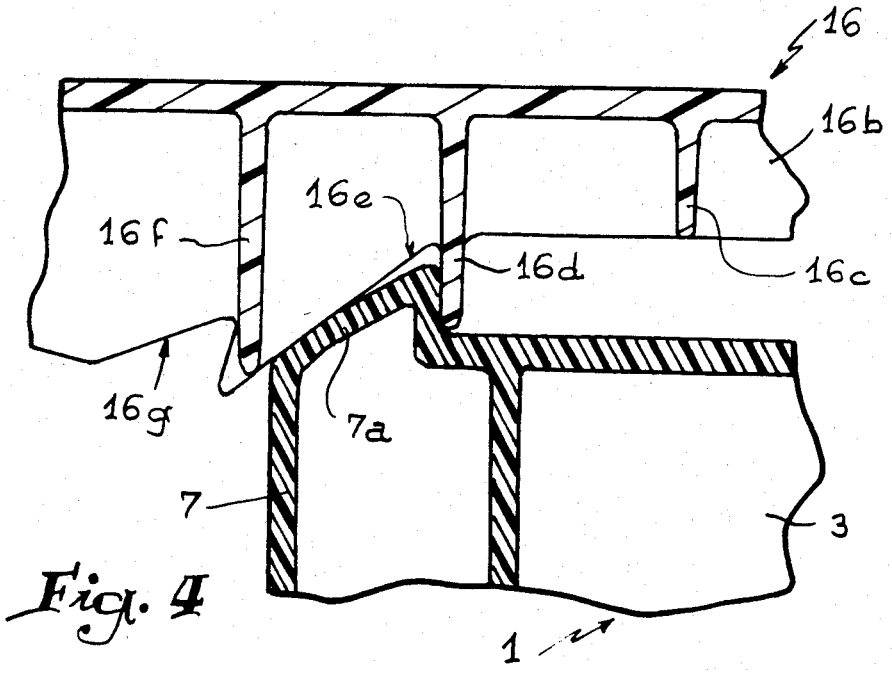
FIG. 4 illustrates how the end panel of the leg rest abuts on the frame in the position illustrated in FIG. 2 of the chair according to the invention.

The leg rest 16 which, for its part, is articulated about pivots 12 and 14, is constituted by two panels 16*a*, 16*b* of which the former comprises at the level of one of its ends means for pivoting about pivots 12-14. The other end of panel 16*a* is pivotally associated with the end panel 16*b*. The latter comprises on its outer face transverse reinforcing ribs referenced 16*c*. Two of these ribs are extended downwardly so that, in horizontal position of the leg rest, one of these ribs referenced 16*d* abuts against two blocks 7*a* made at each end of the crosspiece 7, as illustrated in FIG. 1. The vertical lateral faces of panel 16*b* each comprise a cant or catch 16*e* which, in the position of FIG. 4, rests against the oblique face of the corresponding block 7*a*.

Figure 5:
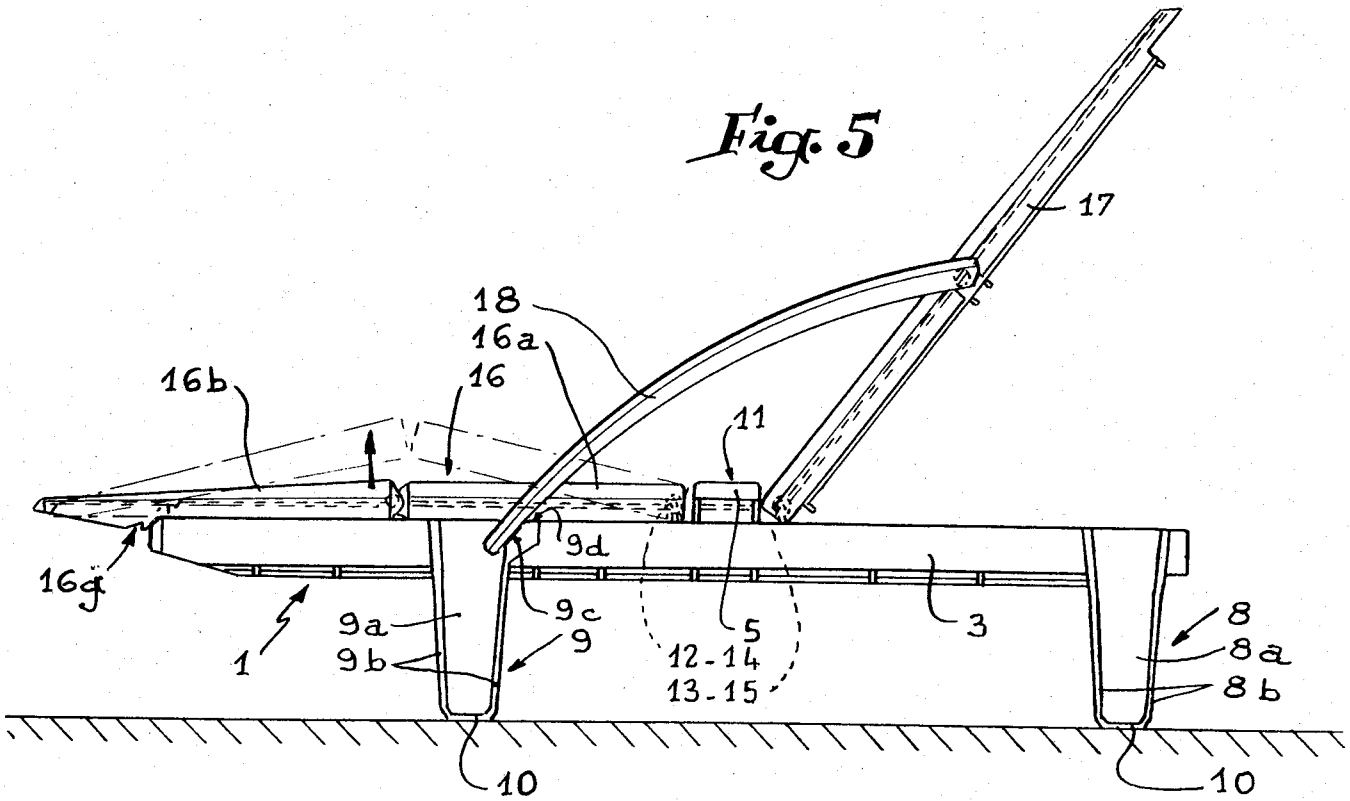
FIGS. 5 and 6 illustrate the chair according to the invention in two positions of use.
Figure 6:
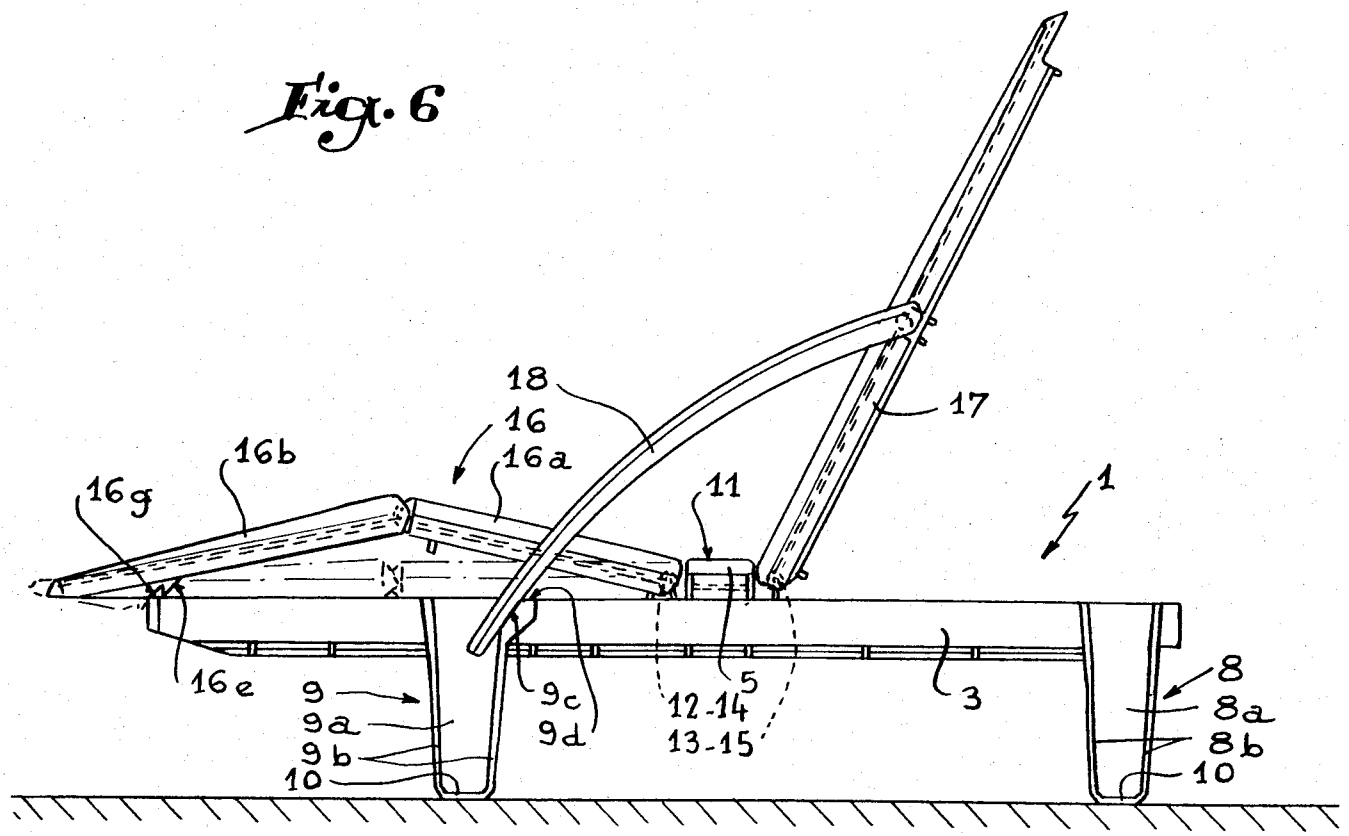
Figure 7:
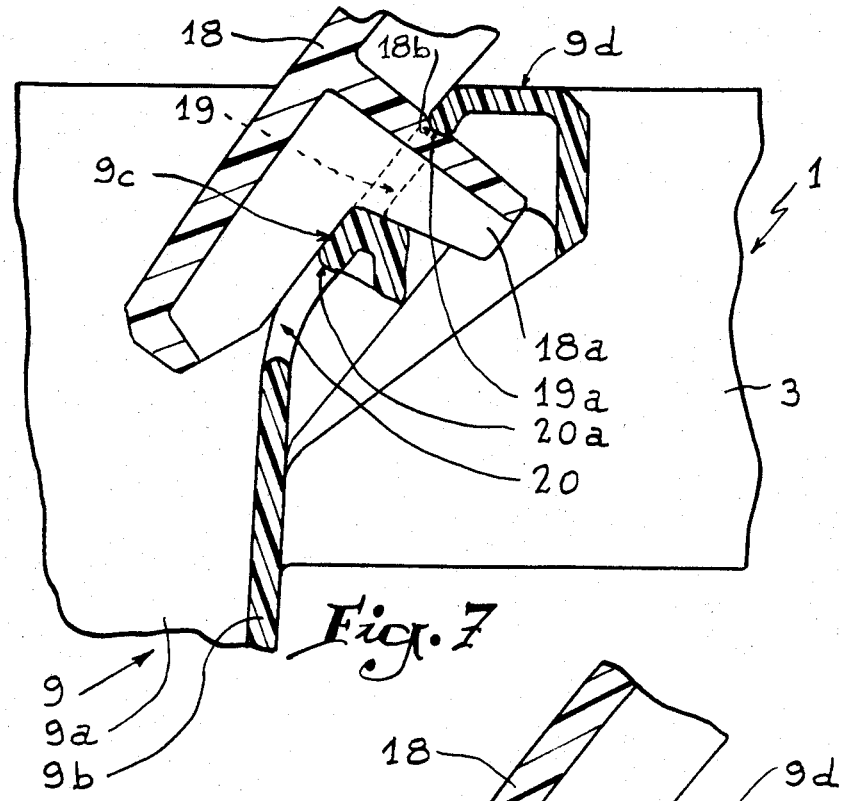
FIGS. 7 and 8 are views similar to that of FIG. 3, but showing how the end of each armrest cooperates with the frame in the positions of the chair illustrated in FIGS. 5 and 6, respectively.
Figure 8:
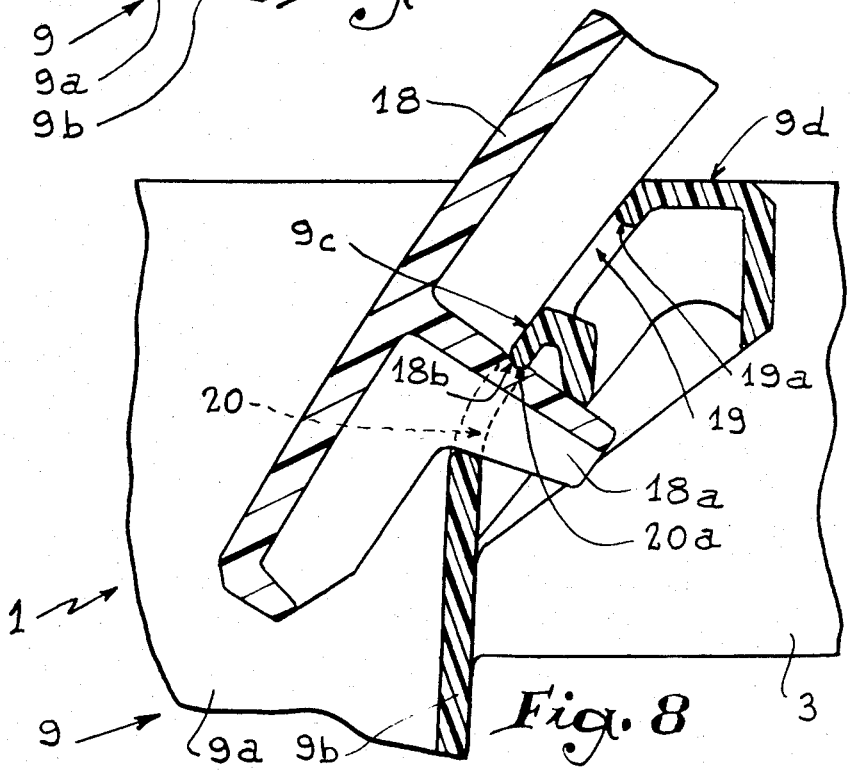

When a user is stretched out in dorsal decubitus on the easy chair of which the elements are horizontal, his buttocks rest on the seat surface 11. If the user sits up, he may grip the arm rests and move them forwardly with a view to tipping the backrest upwardly, for example as illustrated in FIGS. 5 and 6. In the first of these positions, he may bring a finger or extension 18*a* of the armrest into one or the other of two perforations in the form of slots 19, 20 made transversely in the partition 9*c* of the corresponding leg 9. Each finger comprises a groove 18*b* in which is elastically positioned the upper rounded edge 19*a*, 20*a* of each perforation 19, 20. It is observed that, to this end, the finger comprises a certain thickness so that it cooperates with the two edges of each slot, with the result that the armrest is thus wedged in one or the other of its two positions which determine those of the backrest 17 (FIGS. 7 and 8).

Figure 9:
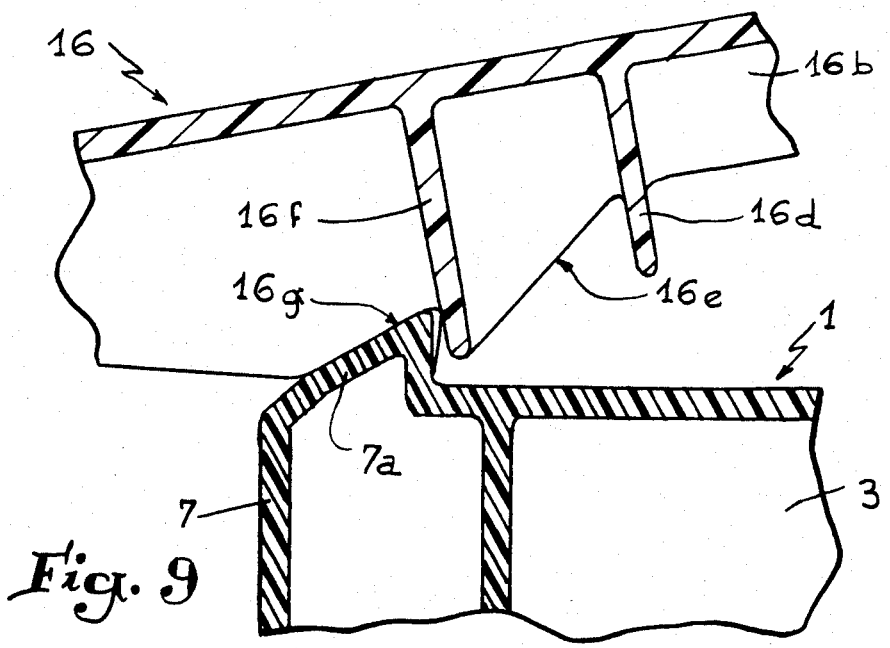
FIG. 9 is a view similar to that of FIG. 4, but corresponding to the position of the chair illustrated in FIG. 6.

As illustrated in FIG. 6, when the user is sitting on the seat surface 11 and his back rests, or not, against the backrest, he can raise the leg rest so that its two panels 16*a*, 16*b* determine therebetween an obtuse angle in order to support the user's legs when they are slightly bent. The fact of bringing the leg rest to this position provokes a displacement of the cants 16*e* with respect to blocks 7*a* of crosspiece 7, so that a stop 16*f* comes into abutment against blocks 7*a*. There again, the lateral faces of the end panel 16*b* of the leg rest 16 comprise cants 16*g* which cooperate with the oblique faces of the blocks 7*a* (FIG. 9). It is observed that stop 16*f* is also a transverse rib whose height is greater than that of rib 16*d* described previously.

It will be readily understood that the change of position of the leg rest is effected without the user having to get off the easy chair and that this change of position is made without effort due to the cooperation of the cants 16*e* with respect to the oblique faces of blocks 7*a*.

As illustrated in FIG. 2, easy chairs according to the invention may be stacked on one another with their hinged elements folded in abutment against the frame since the legs 8 and 9 are offset outwardly, they have an upwardly diverging form and are laterally and outwardly open. The legs of the chairs engage in one another in order to obtain a stack of chairs.

Legs 8 of the chairs may also be associated with dismountable wheels 21 illustrated in discontinous lines in FIG. 2.

It must, moreover, be understood that the foregoing description has been given only by way of example and that it in no way limits the domain of the invention which would not be exceeded by replacing the details of execution described by any other equivalents.

What is claimed is:

1. An easy chair comprising a generally horizontal frame having side and first and second end portions, first and second pairs of depending legs extending from said side portions of said frame, said first pair of said legs being positioned adjacent said first end portion and said second pair of said legs being spaced toward said second end portion of said frame, a seat means extending between said side portions of said frame and being fixedly secured thereto, a backrest means pivotally connected to said frame, a pair of armrests having first and second end portions, said first end portions of said armrests being pivotally connected to said backrest means, said second ends of said armrests extending into contact with said second pair of legs, support means associated in said second pair of legs for adjustable supporting said second ends of said armrests therein, and leg rest means mounted to said frame and spaced from said backrest means.

2. The easy chair of claim 1 in which said legs are offset outwardly with respect to said side portions of said frame and have generally U-shaped flanges extending outwardly thereof and being of a shape to cooperatively accommodate the legs of a second easy chair to be seated therein.

3. The easy chair of claim 2 in which said support means associated with said second pair of legs includes an inclined surface member formed in said flanges over which said second ends of said armrests are slidably engageable and at least two openings in said inclined surface member in spaced relationship to one another, extension means depending from said armrest means adjacent said second end thereof, said extension means being selectively engageable with either of said openings in said inclined surface member to thereby adjust the angle of inclination of said backrest means.

4. The easy chair of claim 3 in which said openings in said inclined surface member are defined by rounded wall elements, a notch formed in each of said extension means, said notches being of a size to permit said rounded wall elements to be cooperatively engaged therein to lock said armrest means within said openings.

5. The easy chair of claim 2 in which said leg rest means includes first and second panels which are hinged for movement with respect to one another, said first panel of said leg rest means being pivotally connected to said frame means, abutment means carried by said frame means adjacent said second end portion thereof, and at least one catch means carried by said second panel of said leg rest means for selectively engaging said abutment means to thereby retain said first and second panels in angled relationship to one another.

6. An easy chair comprising a generally horizontal frame having side and first and second end portions, first and second pairs of depending legs extending from said side portions of said frame, said first pair of said legs being positioned adjacent said first end portion and said second pair of said legs being spaced inwardly of said second end portion of said frame so that said frame overhangs said second pair of legs, said legs being offset outwardly with respect to said side portions of said frame and having opposing inclined flange portions which extend outwardly thereof and being spaced so as to cooperatively accommodate the legs of a second easy chair to be seated therebetween, a seat means extending between said side portions of said frame and being fixedly secured thereto, first and second pivot means mounted to said side portions of said frame on opposite sides of said seat means, a backrest means connected to said first pivot means so as to be pivoted with respect to said frame, a pair of armrests having first and second end portions, said first end portions of said armrests being pivotally connected to said backrest means, said second ends of said armrests extending into contact with said second pair of legs, support means in said second pair of legs for adjustable supporting said second ends of said armrests therein, leg rest means having first and second panels which are hinged for movement with respect to one another, and said first panel of said leg rest means being connected to said second pivot means.

7. The easy chair of claim 6 including abutment means carried by said frame means adjacent said second end portion thereof, and at least one catch means carried by said second panel of said leg rest means for selectively engaging said abutment means.

8. The easy chair of claim 7 in which said support means associated with said second pair of legs includes an inclined surface member formed in said flanges over which said second ends of said armrests are slideably engageable and at least two openings in said inclined surface member in spaced relationship to one another, extension means depending from said armrest means adjacent said second end thereof, said extension means being selectively engagable with either of said openings in said inclined surface member to thereby adjust the angle of inclination of said backrest means.

9. The easy chair of claim 8 in which said openings in said inclined surface member are defined by rounded wall elements, a notch formed in each of said extension means, said notches being of a size to permit said rounded wall elements to be cooperatively engaged therein to lock said armrest means within said openings.

* * * * *